US006698854B1

(12) United States Patent
Knox, Jr. et al.

(10) Patent No.: US 6,698,854 B1
(45) Date of Patent: Mar. 2, 2004

(54) KEY ORGANIZER

(75) Inventors: William J. Knox, Jr., Painesville, OH (US); John R. Nottingham, Hunting Valley, OH (US); John W. Spirk, Gates Mills, OH (US)

(73) Assignee: Mag-Nif Incorporated, Mentor, OH (US)

( * ) Notice: Subject to any disclaimer, the term of this patent is extended or adjusted under 35 U.S.C. 154(b) by 0 days.

(21) Appl. No.: 10/040,673

(22) Filed: Jan. 7, 2002

(51) Int. Cl.[7] ..... A47F 5/00
(52) U.S. Cl. ..... 312/307; 211/1.56; 211/122
(58) Field of Search ..... 312/266, 267, 312/134, 268, 204; 211/1.56, 85.9, 122

(56) References Cited

U.S. PATENT DOCUMENTS

| | | | | |
|---|---|---|---|---|
| 2,778,504 A | | 1/1957 | Byrne | |
| 2,880,878 A | | 4/1959 | Collette | |
| 2,980,258 A | | 4/1961 | Collette | |
| 3,118,531 A | | 1/1964 | Rutkovsky et al. | |
| 3,338,420 A | | 8/1967 | McClenny et al. | |
| 3,339,744 A | | 9/1967 | Ginsberg | |
| 3,697,148 A | * | 10/1972 | Weber | 312/268 |
| D229,909 S | | 1/1974 | Goldfeder | |
| 4,010,868 A | | 3/1977 | Rese et al. | |
| 4,425,772 A | | 1/1984 | Brewer | |
| 4,467,920 A | | 8/1984 | Smith | |
| 4,742,924 A | | 5/1988 | Tarlow et al. | |
| 4,752,876 A | | 6/1988 | Couch et al. | |
| D298,591 S | | 11/1988 | Arner et al. | |
| 4,799,587 A | | 1/1989 | Desanto | |
| 4,984,854 A | * | 1/1991 | DeLavallade | 312/330.1 |
| 4,998,857 A | * | 3/1991 | Paravella et al. | 414/331.03 |
| 5,172,829 A | | 12/1992 | Dellicker, Jr. | |
| 5,207,335 A | * | 5/1993 | Voelz | 211/122 |
| 5,291,768 A | | 3/1994 | Rieffel et al. | |
| 5,305,890 A | * | 4/1994 | Ishikawa | 211/122 |
| D355,770 S | | 2/1995 | Taylor et al. | |
| 5,474,187 A | | 12/1995 | Taylor et al. | |
| 5,645,173 A | | 7/1997 | Taylor et al. | |
| 5,836,675 A | | 11/1998 | Woodring | |
| 5,899,501 A | | 5/1999 | Maxwell | |
| 6,006,562 A | | 12/1999 | Wolter | |
| 6,237,756 B1 | | 5/2001 | Caudle | |

OTHER PUBLICATIONS

Mag–Nif makes it in the U.S.A.! brochure, 1999.

* cited by examiner

*Primary Examiner*—Lanna Mai
*Assistant Examiner*—Jerry A. Anderson
(74) *Attorney, Agent, or Firm*—Fay, Sharpe, Fagan, Minnich & McKee, LLP

(57) ABSTRACT

The key organizer has a housing with a first section and a second section which are pivotally connected. First and second drums are rotatably mounted on axles within a cavity of the housing. A first belt is engaged with the first and second drums and has a plurality of suspension points for hanging articles thereon. A drive mechanism is connected to one of the drums for rotating one of the drums to cause rotation of the belt. A switching device is connected to the drive mechanism for selectively continuously activating the drive mechanism. Third and fourth drums are mounted onto the axles in spaced relation to the first and second drums. A second belt engages these drums. The drive mechanism has a gear train with a drive gear and additional gears which matingly engage the drive gear. A locking mechanism locks the first and second sections together. A light can be mounted onto one of the first and second sections for illuminating the housing cavity.

22 Claims, 8 Drawing Sheets

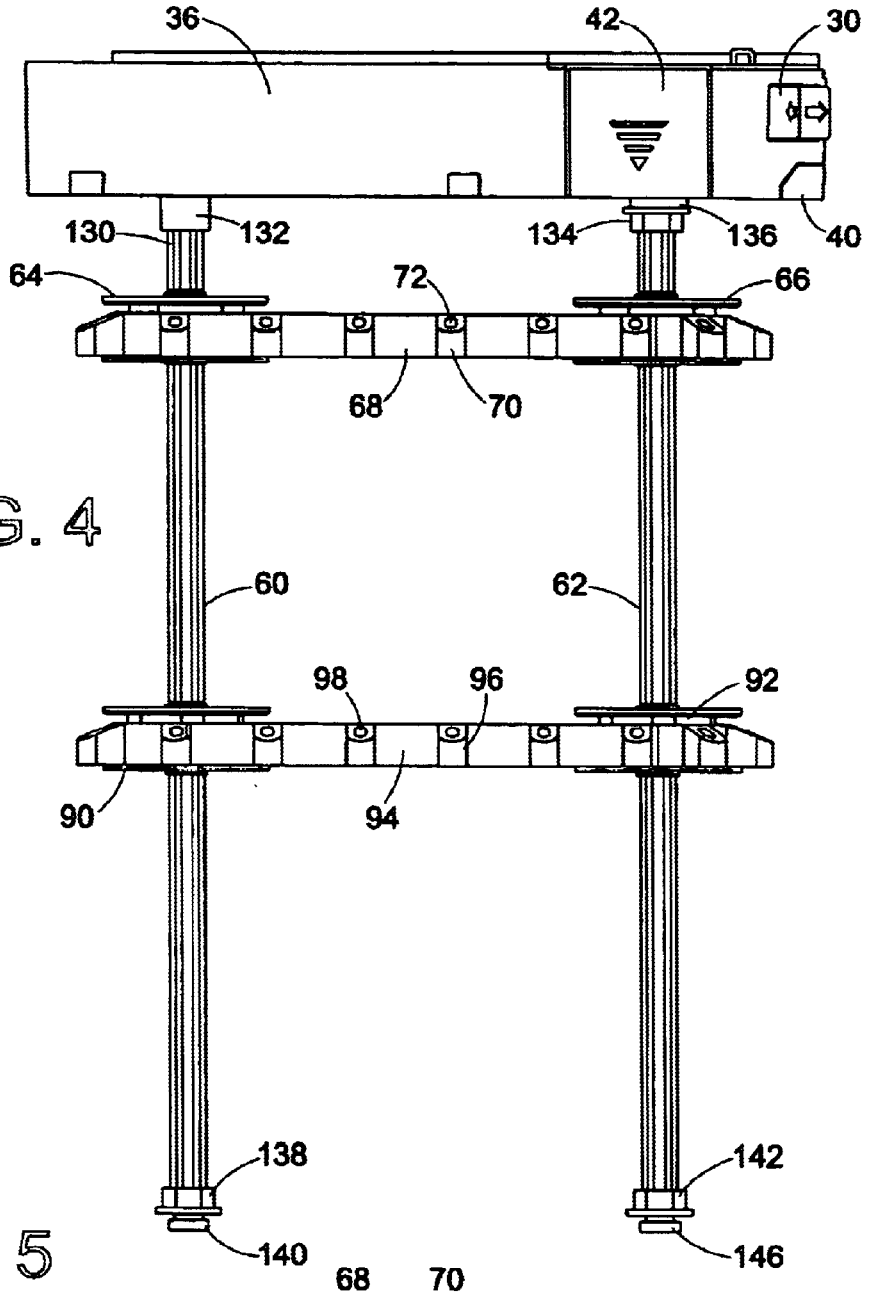
FIG. 4
FIG. 5
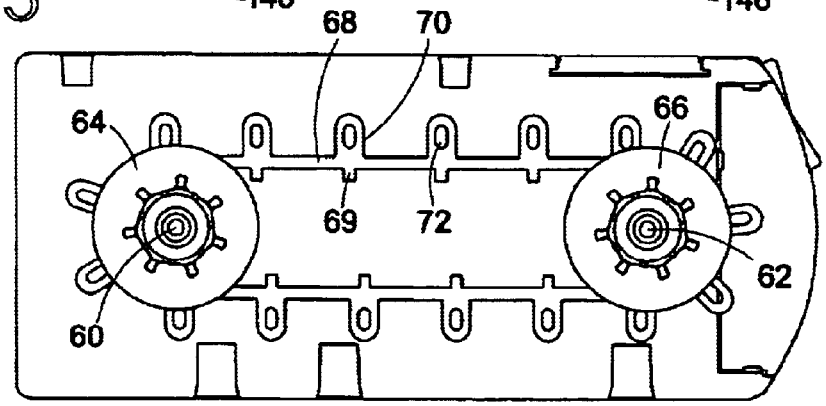

KEY ORGANIZER

BACKGROUND OF THE INVENTION

The present invention relates to an apparatus for organizing articles, and in particular relates to an organizer for the storage of keys.

It is a common practice to hang keys (e.g. car keys, house keys, and safe deposit keys) on static key holders or pegs. These key holders may be hung in various areas of a household. This, however, leaves the keys susceptible to being misplaced, accessed by small children, or possibly stolen. Alternatively, if too many keys are carried around by a person, such as on a chain or a ring, the loose keys can rub against a person's pocket and damage the pocket fabric. It is also cumbersome to carry large quantities of keys.

The storage of keys or other similar articles by static devices has had some disadvantages. These static devices often position the articles very close together, often overlapping the articles, such that an individual article cannot be easily located and retrieved without sorting through various articles.

Various dynamic devices have also been used to store articles. However, these dynamic devices suffer from a number of disadvantages. A few of these are inadequate control for easy location and retrieval of the articles, inadequate lighting, difficult installation, and inefficient use of space. Furthermore, many of these devices do not provide for locked storage of the articles in a housing, such as keys, so that the articles are not visible or accessible without unlocking the device.

Thus, there is a need for an apparatus for storing articles like keys which overcomes the disadvantages of the above mentioned static and dynamic devices. It would be beneficial to have a key storage device that provides for storage of a large quantity of keys in a safe, locked condition. Accordingly, it is desirable to develop a new and improved key organizer which would overcome the foregoing deficiencies and others while meeting the above-stated needs and providing better and more advantageous overall results.

SUMMARY OF THE INVENTION

The present invention relates to a new and improved key organizer. More specifically, the key organizer is used to provide organized storage and a locked receptacle for the keys.

The key organizer comprises a housing having a first section and a second section movably connected to each other. At least one of the first and second sections defines a cavity. The second section is movable from a first position in which access is allowed to the cavity to a second position in which access is foreclosed to the cavity.

First and second drums are rotatably mounted to the housing within the cavity. The drums are located in a common plane and are spaced apart from each other. A first belt is engaged with the drums and has a plurality of suspension points for hanging articles thereon. A drive mechanism is connected to one of the drums for rotating the drum to cause rotation of the belt. A switching device is connected to the drive mechanism for selectively continuously activating the drive mechanism. A light can be mounted onto one of the first and second sections and is connected to the switching device to be selectively continuously operated.

The organizer further has a first axle onto which the first drum is mounted and a second axle onto which the second drum is mounted. Third and fourth drums can be mounted onto the first and second axles. The third drum is mounted onto the first axle in a spaced relation to the first drum. The fourth drum is mounted onto the second axle in a spaced relation to the second drum. A second belt engages the third and fourth drums.

The drive mechanism comprises a gear train having a drive gear and at least one additional gear which matingly engages the drive gear. A motor is operatively connected to the gear train. At least one battery powers the motor. The key organizer also comprises a motor housing for the motor and a plate which are spaced apart from each other. The plate forms a bottom wall of the device.

A locking mechanism is located on one of the first and second sections to lock the first and second sections together. The second section can be pivotally mounted on the first section along a vertically extending hinge. The lock includes a first element on the first section and a second element on the second section where the first and second elements are movable in relation to each other.

Still other aspects of the invention will become apparent to those skilled in the art upon reading and understanding the following detailed description.

BRIEF DESCRIPTION OF THE DRAWINGS

The invention may take form in certain components and structures, several preferred embodiments of which will be illustrated in th<accompanying drawings wherein:

FIG. 4 is a side elevational view of chain and drum assembly of the key organizer of FIG. 3;

FIG. 5 is a top plan view of the chain and drum assembly of FIG. 4;

DETAILED DESCRIPTION OF THE EMBODIMENTS

Figure 1:
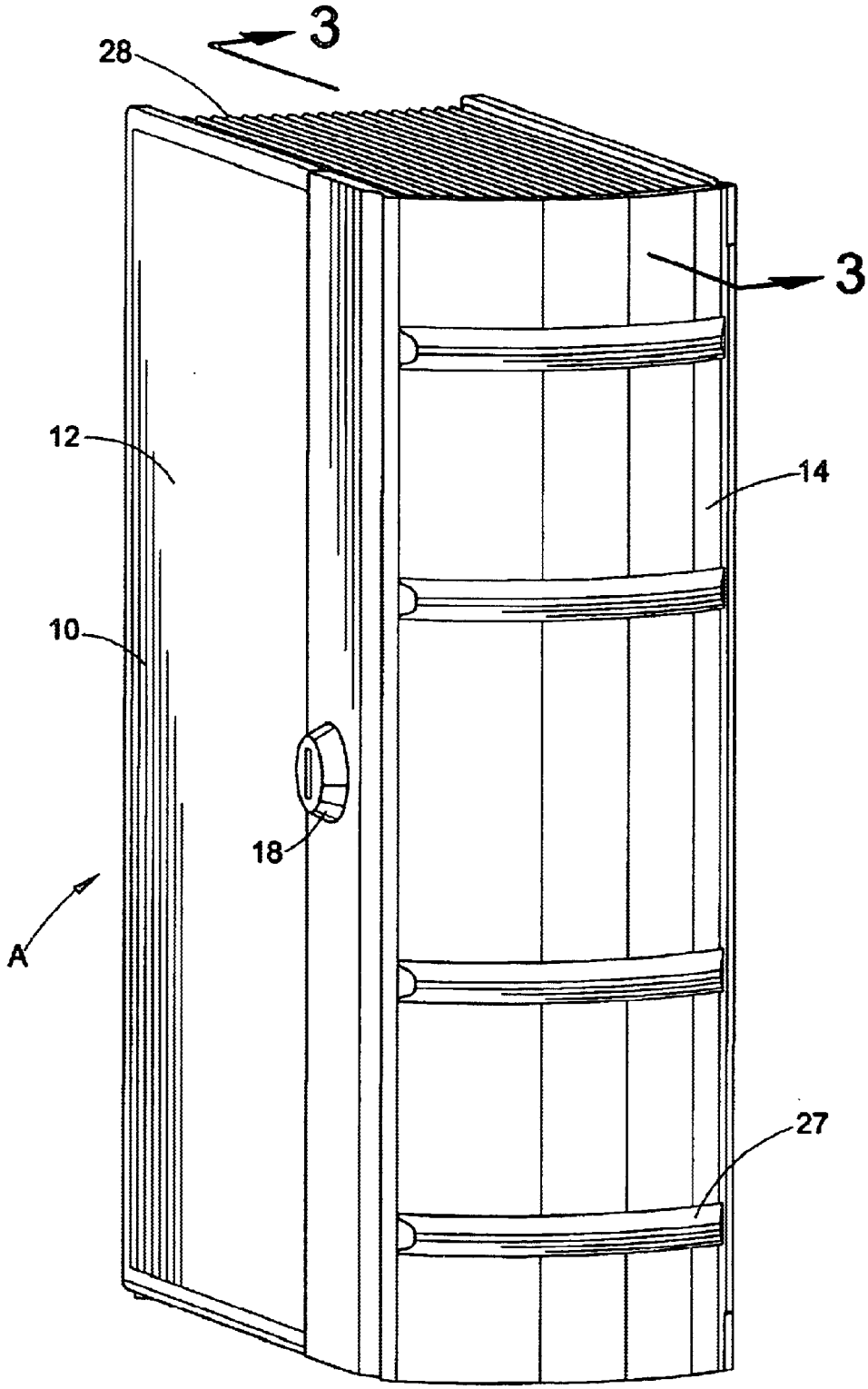
FIG. 1 is a perspective view of a key organizer in a closed configuration according to a first embodiment of the present invention.

Referring now to the drawings, wherein the showings are for purposes of illustrating several preferred embodiment of the invention only and not for purposes of limiting same, FIG. 1 shows a key organizer A according to one embodiment of the present invention.

More specifically, the key organizer A comprises a housing 10 comprising a first section 12 and a second section 14 which is pivotally connected to the first section. Together, the first section and second section define a cavity 16 within the housing (See FIG. 2). The second section 14 acts as a door which is pivotally connected by a hinge 17 along a vertical axis to the first section 12. Of course, other conventional means of movably mounting the second section to the first section could also be used. For example, the second section 14 could slide with respect to first section 12 to open and close cavity 16. On the door 14 is located a lock assembly 18 which has a first, movable portion 20 on the door, and a second, fixed portion 22 located on the first section 12.

The key organizer is designed to have the appearance of a book. The organizer can be stored within a library or den between books to keep the organizer hidden and out of view. The first section 12 has two halves 24 and 26, formed of hard plastic, which together form the appearances of the front and back hard portions of the cover of a book. The second section 14 simulates the spine of a book. There are also ribs 27 on the second section 14 which are designed to appear as the binding of the book cover. There are ribs 28 which are formed on the first section 12 to simulate the appearance of pages within the book. The key organizer may take form of other articles, such as an index card holder. The key organizer can also be fabricated from metal without departing from the scope and intent of the present invention.

Figure 2:
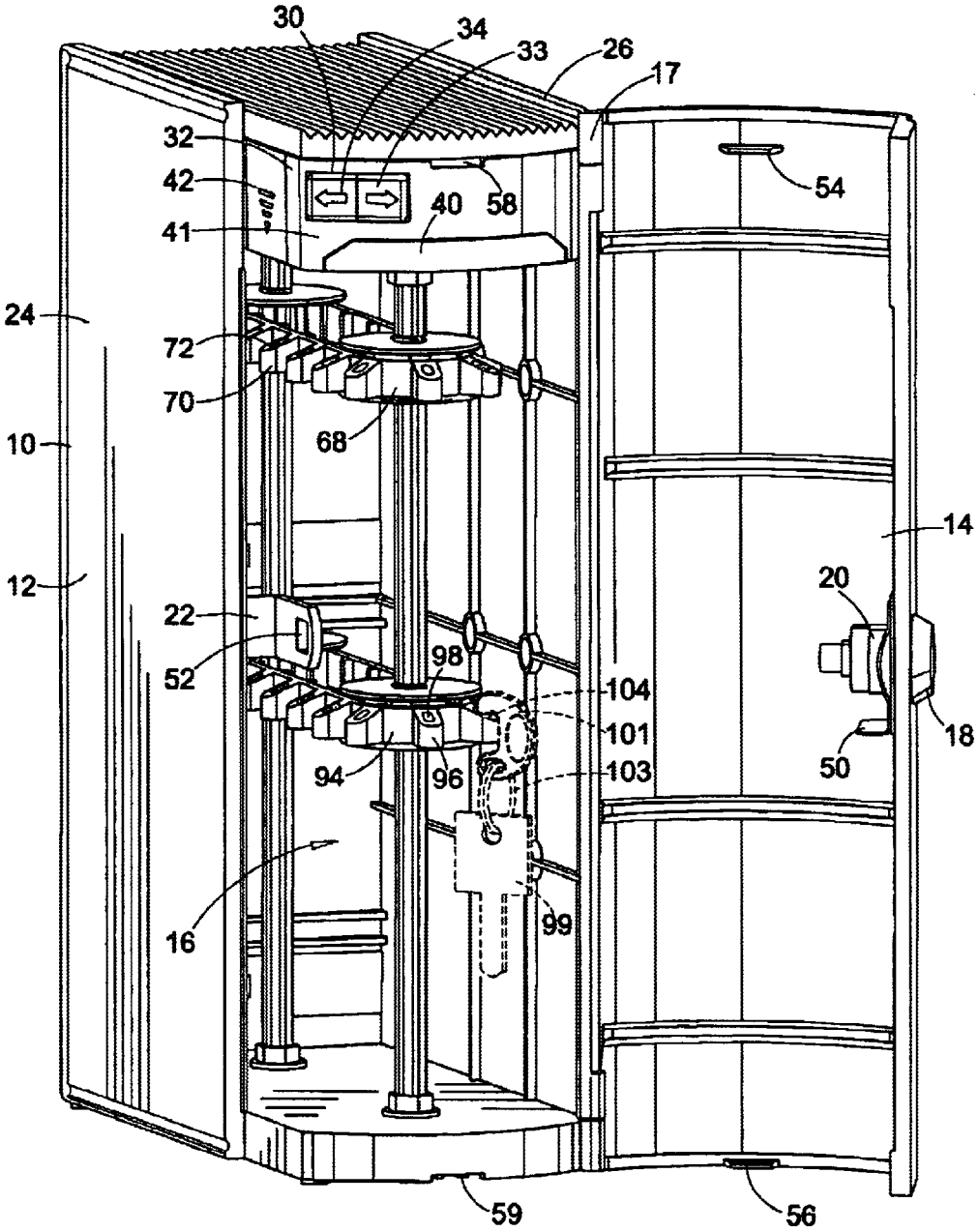
FIG. 2 is a perspective view of the key organizer of FIG. 1 in an opened configuration.

Referring now to FIG. 2, a button or switch mechanism 30 is positioned on a housing 32, located adjacent the top portion of the first section 12, for storing batteries. The switch has a forward button 33 and a reverse button 34.

Figure 3:
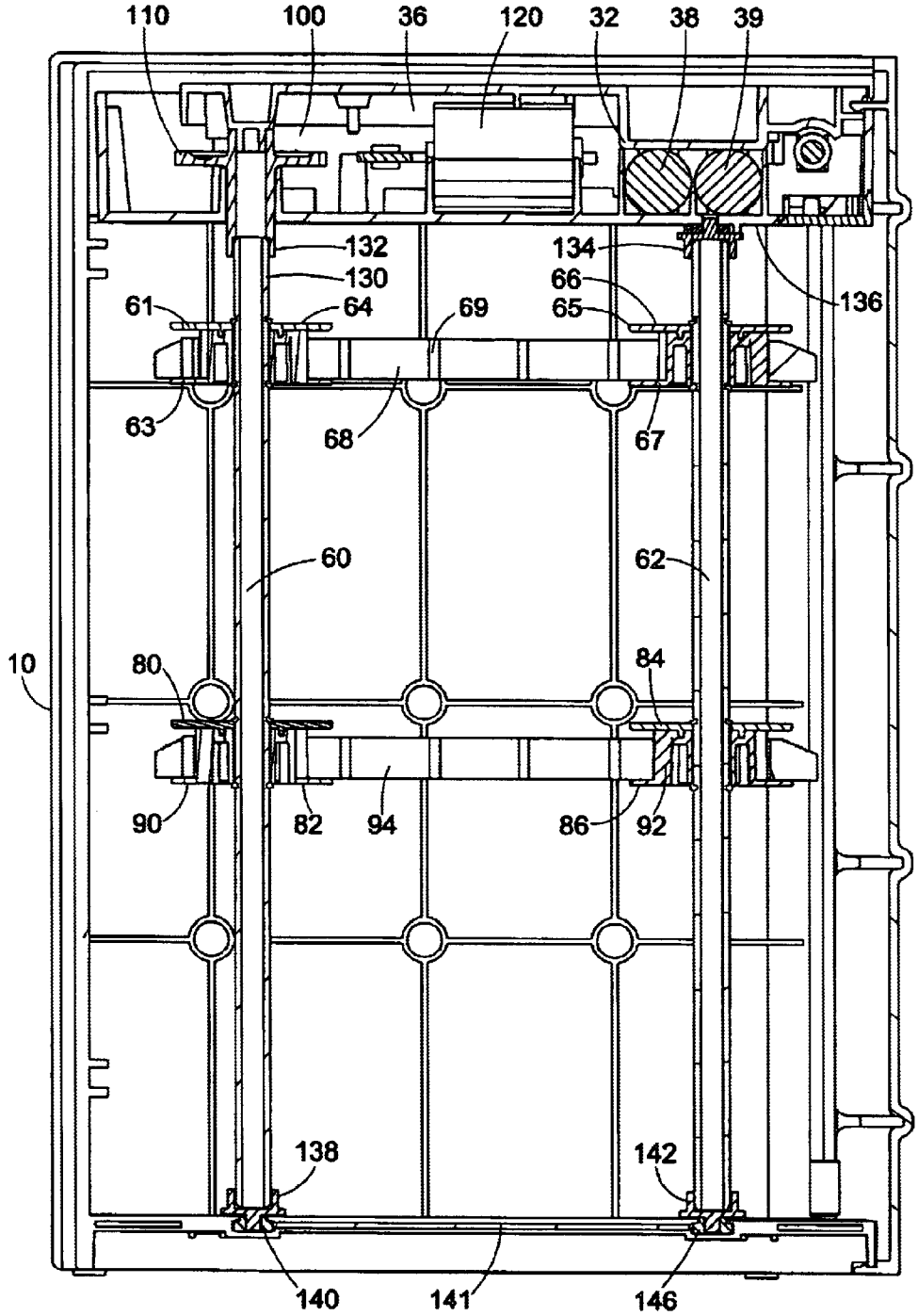
FIG. 3 is a side cross-sectional view of the interior of the key organizer of FIG. 1.

Referring to FIGS. 3 and 4, the battery housing 32 is adjacent to a motor housing 36. A pair of batteries 38, 39 are disposed within the battery housing. A light 40 is positioned at a first end 41 of the battery housing. A pivotable door 42 shown in FIG. 4 is used to open the battery housing and remove or install the batteries.

Referring again to FIG. 2, the lock assembly has a tab 50 on one portion 20 which engages a slot 52 on other portion 22 of the lock assembly. When the door is in the closed position the tab engages the slot to lock the door 14 to the first section 12. Tabs 54, 56 on door 14 are received in slots 58, 59 on first section 12 to further capture the door 14 to the first section. As shown in FIGS. 1 and 2, the first section is movable from a position which allows access to the cavity to a position which forecloses access to the cavity.

Figure 6:
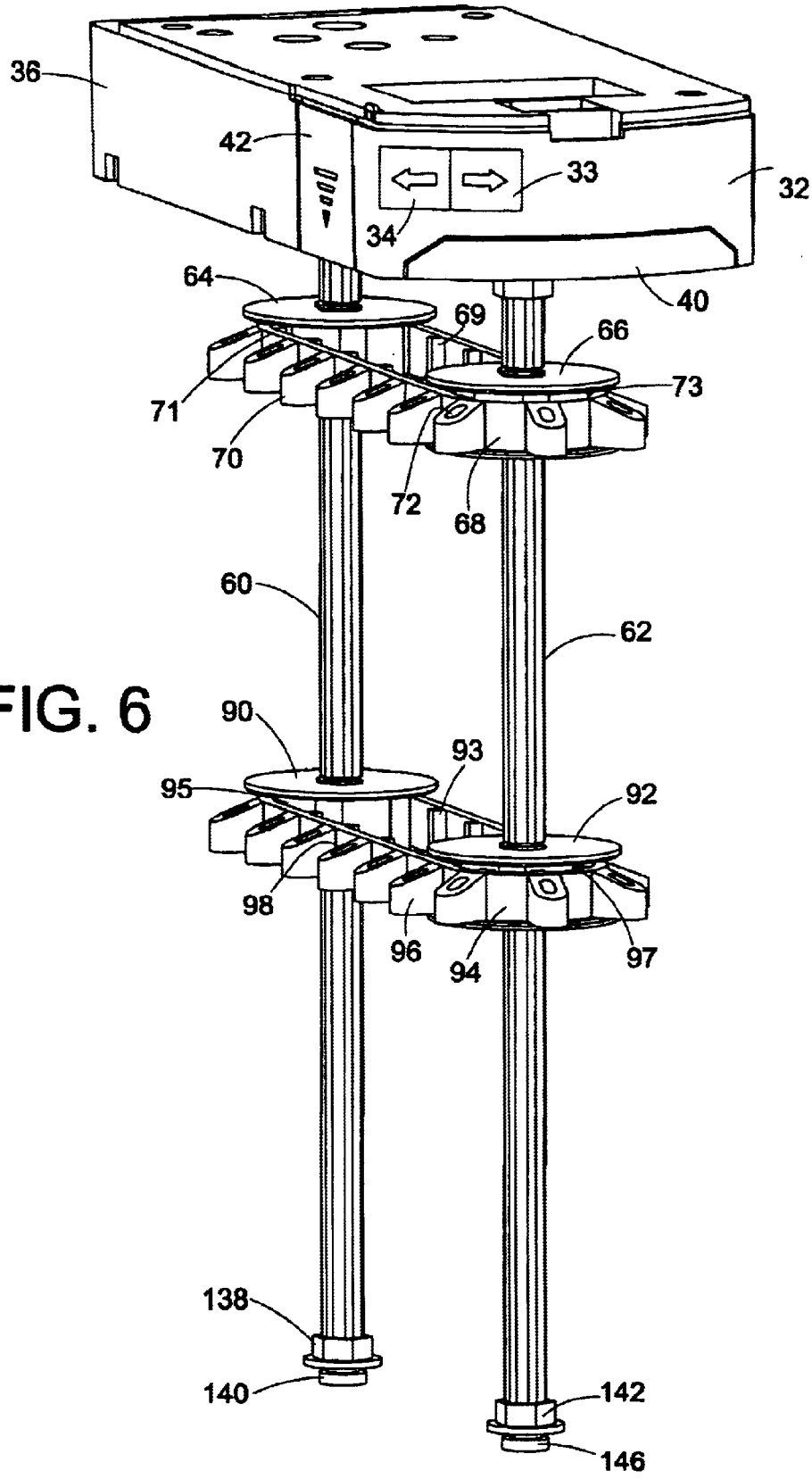
FIG. 6 is a perspective view of a motor and gear housing and the chain and drum assembly of FIG. 4.

Referring to FIGS. 3 and 4, within the cavity of the key organizer, there are two rods or axles 60, 62 which are vertically disposed within the cavity and are spaced apart and are oriented approximately parallel to each other. A first drum 64 is located on the first axle 60 and a second drum 66 is located on the second axle 62. The first and second drums are spaced apart and are located in approximately the same plane. A first belt or chain 68, which can be made of rubber, engages the first and second drums. The belt 68 engages the drums; that is, the belt is prevented from sliding or moving along the axles and off of the drums due to flanges on the drums. Drum 64 has flanges 61, 63 and drum 66 has flanges 65, 67. Each of the pairs of flanges are spaced apart and generally parallel to each other. The belt is installed on the two drums around an outside perimeter of each drum. The belt has a plurality of ribs 69 generally equally spaced apart which are received by slots or grooves 71, 73 on drums 64, 66, respectively (see FIGS. 5 and 6). The belt has a plurality of lobes 70 for hanging articles thereon such as keys or other type of articles. Slots 72 within each lobe are used for retaining keys.

Figure 10:
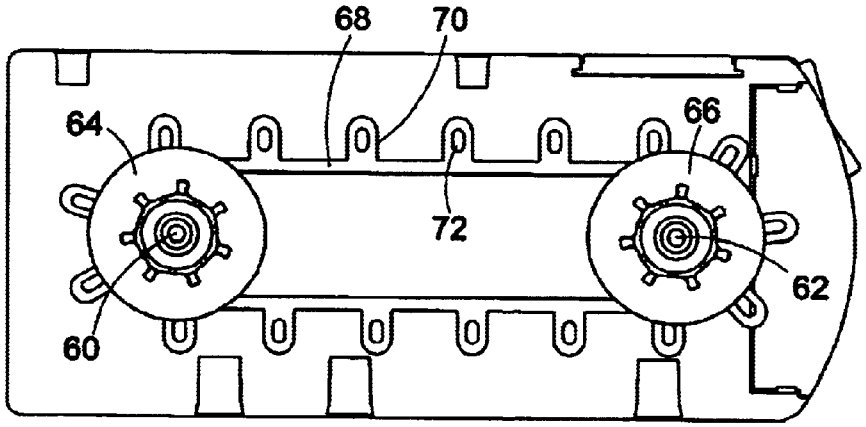

An alternate drum and belt assembly is shown in FIG. 10. In the arrangement, belt 68 does not have ribs thereon. Furthermore, drums 64, 66 do not have slots thereon for receiving ribs. Another alternate arrangement would include the belt having ribs and one of the drums having slots for receiving the ribs. The other drum would receive the belt in a frictional engagement but would be idle. The belt would be able to slide on the drum and may partially rotate the drum.

Figure 8:
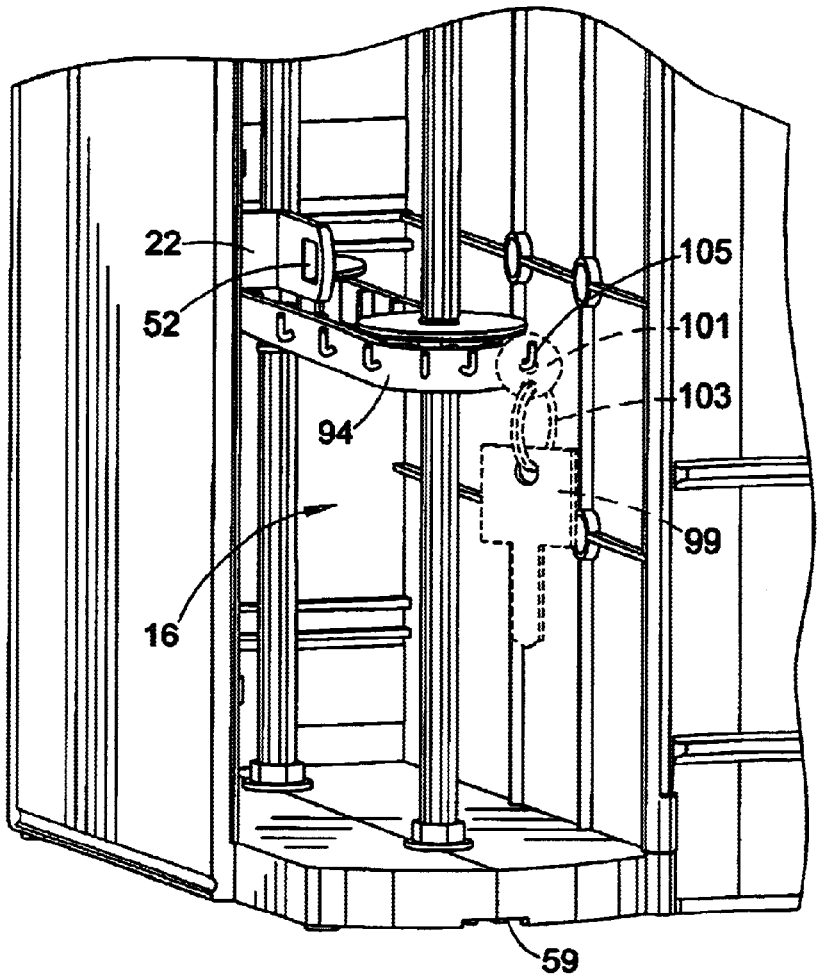
FIG. 8 is a perspective view of a portion of the organizer illustrating a belt with hook members extending therefrom according to a second embodiment of the present invention.

Referring to FIGS. 3 and 4, a third drum 90 and a fourth drum 92 are spaced apart and are located approximately in the same plane. These drums are located on the first axle 60 and second axle 62, respectively. The third drum is spaced apart and aligned with the first drum and the fourth drum is spaced apart and aligned with the second drum. A second belt or chain 94 engages the third and fourth drums. Belt 94 engages the drums and is prevented from sliding or moving along axles 60, 62 by flanges on each drum. Drum 90 has flanges 80, 82 and drum 92 has flanges 84, 86. Each pair of flanges are spaced apart and generally parallel to each other. The second belt can be made from rubber. The second belt engages an outer periphery of each drum 90, 92 and is spaced apart and approximately parallel to the first belt or chain 68. The second belt has a plurality of ribs 93 generally spaced apart which are received by slots or grooves 95, 97 on drums 90, 92, respectively. The second belt also has a plurality of lobes 96 or other conventional suspending means for hanging articles thereon such as hooks, pegs and the like (See FIGS. 2–4). Each lobe has a slot 98 through the lobe for retaining a key. As seen in FIG. 1, a key 99 is engaged with slot 98 via a fob 101 on which the key can be mounted via a ring 103. The fob has a projection 104 installed in the slot 98. Of course, other conventional ways of mounting keys on a holder could also be used. For example, as seen in FIG. 8, instead of lobes, hooks 105 may by be used with key rings.

A drive mechanism 100 is connected to one of the first or second axles for rotating the drums to then cause rotation of the belt or chain. The switching device 30 is also connected to the drive mechanism to selectively activate the drive mechanism as long as the switch is being pushed. In other words, if the forward button 33 is pushed, the drums will rotate in one direction and if the reverse button 34 is pushed, the drums will rotate in the opposite direction. The switch 30 is spring biased to a neutral position and will stop any further rotation of the drums when it is no longer being depressed in either direction.

Figure 7:
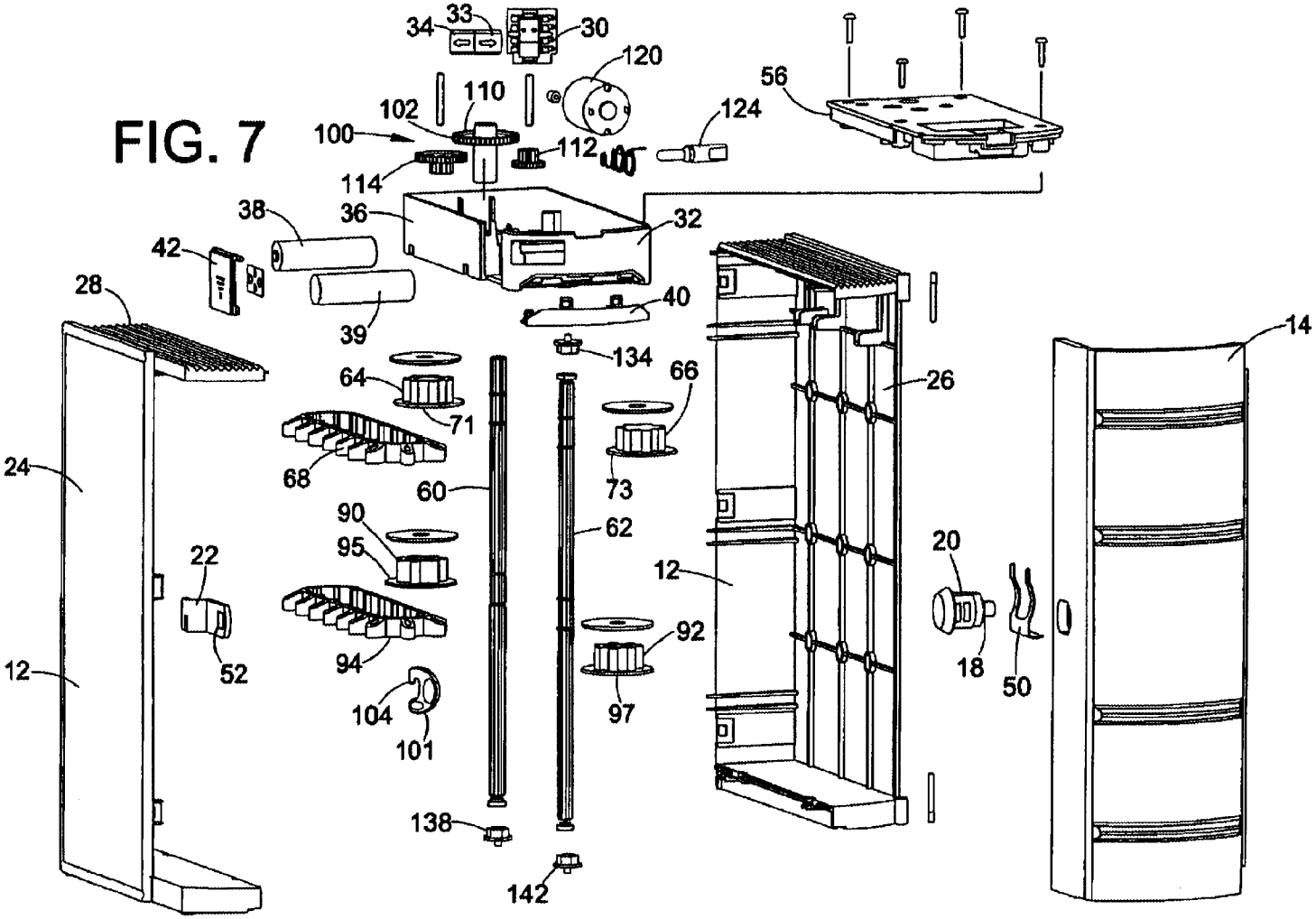
FIG. 7 is a perspective view of the key organizer of FIG. 1.

Referring to FIG. 7, the drive mechanism comprises a gear train 102 having a drive gear 110 and a first gear 112 and a second gear 114 matingly engaging the first gear and each other. The drive gear 110 is mounted onto the first axle 60. As the drive gear is rotated by the first and second gears, the axle 60 in turn is also rotated which in correspondingly rotates the first and third drums 64, 90. A motor 120 is operably connected to the second gear 114. The batteries are connected to the motor for powering the motor. As shown in FIG. 7, a switch activator 124 is connected to the batteries which is activated by switch 30 for powering the motor.

Referring to FIG. 3, the first axle has a notched end 130 which engages an opening 132 at the base of the drive gear 112. The second axle has a notched end 134 which engages an opening 136 at a bottom edge of the battery housing. These ends allow the axles to rotate when pulled by the belt. The first axle also has an adapter end 138 which engages an opening 140 in a bottom plate 141 of the housing. The second axle has an adapter end 142 which engages an opening 146 in the plate 141 located at the bottom of the housing. The motor housing 36 and the plate 141 are spaced apart and are approximately parallel to each other. They form top and bottom portions of the housing, respectively.

Figure 9:
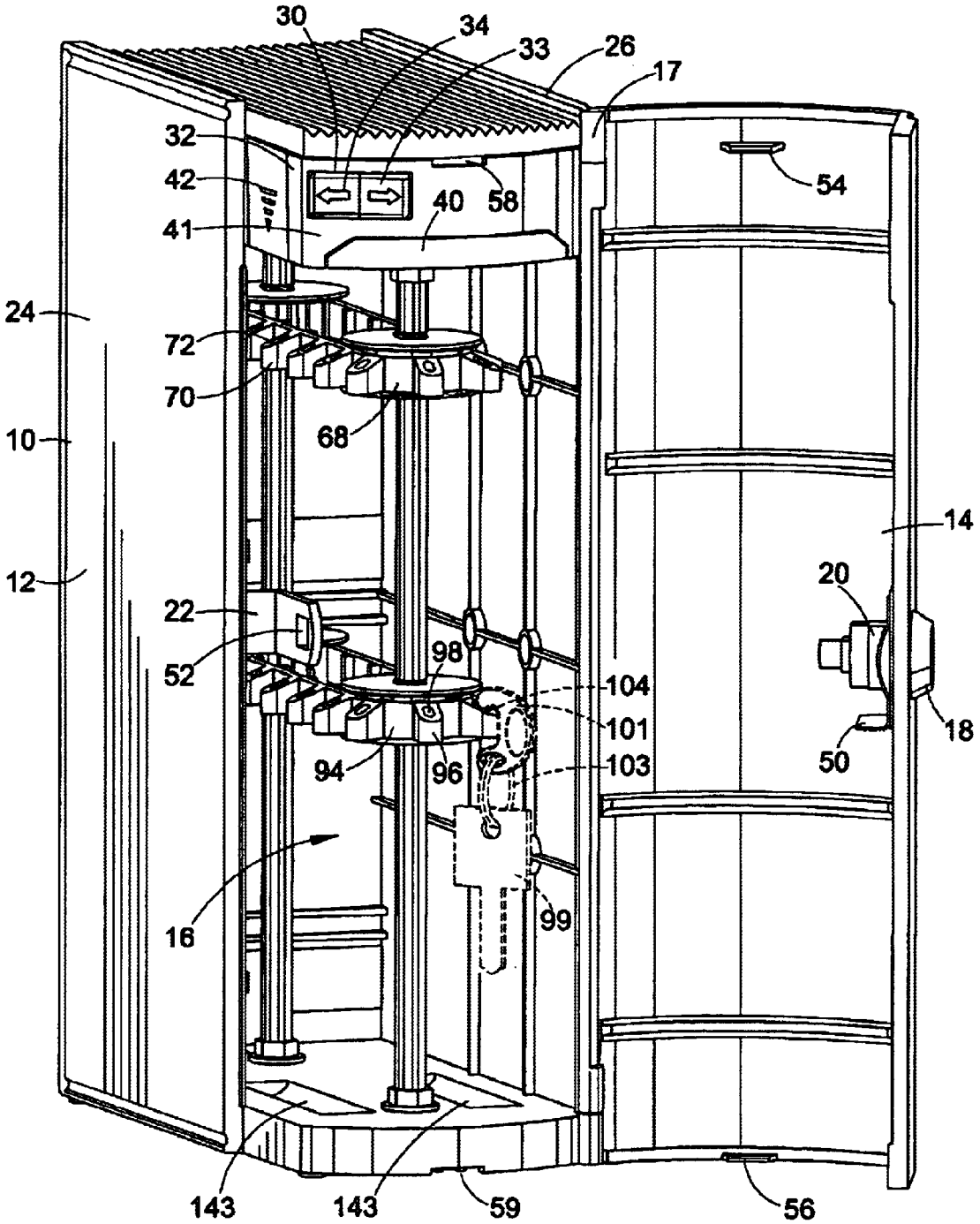
FIG. 9 is a perspective view of the key organizer with wells in a bottom plate according to a third embodiment of the present invention; and, FIG. 10 is a top plan view of a belt and drum assembly with a belt without ribs in accordance with a fourth preferred embodiment of the present invention.

Along with the first and second sections they form the cavity which encloses the first and second axles, the drums, and the belts. If desired, bottom plate 141 may have a depression or well 143 which can accommodate larger fobs such as those used for car keys which have built-in remote control locks for car doors (see FIG. 9).

During operation, the user depresses the switch 30 to the forward or reverse position. The switch activator 124 then engages the batteries 38, 39 which in turn power the motor 120 to rotate the first and second gears 112, 114 of the gear train which move the drive gear 110 assembly that is drivingly connected to the first axle. The first axle then rotates which in turn rotates the first and third drums 64, 90. These drums rotate the first and second belts 68, 94 which are mounted on the second and fourth drums 66, 92. These drums are in turn also rotated which rotates the second axle 62.

Each lobe on the first and second belts moves at some point to a position near the door 14. When the door is in an opened position, the user can access a key or keys as they become exposed to the open portion of the cavity. The light 40 which is also connected to the switching device is also operated during the motion of the belts. The light is used to illuminate the interior of the cavity to allow the user to better view the keys as they rotate to the open portion of the cavity. Since the organizer will most likely be used in a darkened area such as within a library or study, and will likely be disposed within books on a book shelf, the user will need additional light to view the keys as they come near the opening in the housing when the door 14 is ajar.

When the user is finished installing or removing keys from the lobes on the two belts, the door 14 is then pivotally moved to a closed position as shown in FIG. 1. The lock 18 is locked by a key which is inserted within the first portion 20 of the lock and rotated to engage the tab 50 in the slot 52 in the second portion 22 of the lock. The organizer is then in a locked and closed configuration. Thus, keys within the organizer are not exposed and are safely locked and stored away so that they cannot be stolen or inadvertently accessed by small children. The organizer can then be replaced into its original storage position among a group of books in either a book shelf or a library.

The invention has been described with reference to several preferred embodiments. Obviously, alterations and modifications will occur to others upon a reading and understanding of this specification. For example, while a book-shaped key organizer is discussed herein, the invention could also take the form of an index card box or the like if only a single belt looped on two drums were used. It is intended to include all such modifications and alterations insofar as they come within the scope of the appended claims or the equivalents thereof.

Having thus described the preferred embodiments; the invention is now claimed to be:

1. An apparatus for organizing keys, comprising:

first and second axles rotatably mounted to a housing and located within a cavity thereof, a first drum being mounted on said first axle and a second drum being mounted on said second axle, said first and second drums being located in a common plane and being spaced apart from each other;

third and fourth drums wherein said third drum is mounted onto said first axle in spaced relation to said first drum, said fourth drum is mounted onto said second axle in spaced relation to said second drum;

a first belt engaged with said first and second drums, said belt having a plurality of suspension points for hanging articles thereon;

a second belt engaged with said third and fourth drums;

a lock positioned on said housing, wherein said lock comprises a first element on said first section and a second element on said second section, said first and second elements being movable in relation to each other; and a drive mechanism connected to one of said first and second drums for rotating one of said first and second drums to cause rotation of said belt.

2. The apparatus of claim 1, wherein said housing further comprises a first section and a second section hingedly connected to each other, and a light mounted to one of said first and second sections and which is connected to said switching device to be selectively continuously operated.

3. The apparatus of claim 1, wherein said housing simulates the appearance of a book.

4. An apparatus for organizing keys, comprising:

a housing having a first axle and a second axle mounted thereto, a first drum being mounted on a first axle and a second drum being mounted on a second axle, said first and second drums being located in a common plane and being spaced apart from each other;

third and fourth drums wherein said third drum is mounted onto said first axle in spaced relation to said first drum, and said fourth drum is mounted onto said second axle in spaced relation to said second drum;

a first belt engaged with said first and second drums, said belt having a plurality of suspension points for hanging articles thereon;

a second belt engaged with said third and fourth drums;

a drive mechanism connected to one of said first and second axles for rotating one of said first and second drums to cause rotation of said belt; and a switching device connected to said drive mechanism for selective continuous activation of said drive mechanism.

5. The apparatus of claim 4, wherein said drive mechanism comprises a gear train having a drive gear and at least one additional gear matingly engaged therewith.

6. The apparatus of claim 5, further comprising a motor operatively connected to said gear train.

7. The apparatus of claim 6, further comprising at least one battery for powering said motor.

8. The apparatus of claim 4, wherein said housing comprises first and second sections, and a hinge for pivotally connecting said first and second sections.

9. The apparatus of claim 8, further comprising a locking mechanism located on one of said first and second sections to lock said first and second sections together.

10. The apparatus of claim 8, further comprising a light mounted to one of said first and second sections and which is connected to said switching device to be selectively continuously operated.

11. An apparatus for organizing keys, comprising:

a motor housing forming a first portion of said apparatus and a plate forming a second portion of said apparatus, said motor housing and plate being spaced apart and connected by a wall assembly;

first and second axles rotatably mounted at a first end to said motor housing and at a second end to said plate;

first and second drums, wherein said first drum is mounted to said first axle and said second drum is mounted to said second axle;

a first belt engaged with said first and second drums, said first belt having a plurality of suspension points for hanging articles thereon;

a drive mechanism connected to one of said first and second axles for rotating one of said drums to cause rotation of said belt; and, a motor positioned within said motor housing and operably connected to said drive mechanism for powering said drive mechanism.

12. The apparatus of claim 11, further comprising a switching device connected to said drive mechanism for selective continuous activation of said drive mechanism.

13. The apparatus of claim 12, further comprising a light mounted to one of said motor housing and said at least one wall section.

14. The apparatus of claim 11, wherein said wall assembly comprises a first wall section and a second wall section pivotably connected to each other to form a cavity, at least one of said first and second wall sections extending between and secured to said motor housing and said plate.

15. The apparatus of claim 11, wherein said drive mechanism comprises a gear train have a drive gear and at least one additional gear matingly engaged therewith.

16. The apparatus of claim 11, further comprising third and fourth drums wherein said third drum is mounted onto said first axle in spaced relation to said first drum, said fourth drum is mounted onto said second axle in spaced relation to said drum, and a second belt engaged with said third and fourth drums.

17. The apparatus of claim 11, further comprising a housing, said housing including said at least one wall section and said plate and further comprising a door movably connected to said at least one wall section.

18. The apparatus of claim 17, further comprising a hinge for pivotally connecting said door to said at least one wall section.

19. The apparatus of claim 17, wherein said housing, simulates the appearance of a book.

20. The apparatus of claim 11, wherein said drive mechanism comprises a gear train having a drive gear and at least one additional gear matingly engaged therewith.

21. The apparatus of claim 20, wherein said motor is operatively connected to said gear train.

22. The apparatus of claim 21, further comprising at least one battery for powering said motor.

* * * * *